United States Patent [19]

Cortes Garcia

[11] 4,071,241

[45] Jan. 31, 1978

[54] LARGE FOOT BALLS OR SOCCER BALLS

[76] Inventor: Jose de Jesus Cortes Garcia, Arqueologos No. 57, Col. El Retono, Mexico City, Mexico

[21] Appl. No.: 631,647

[22] Filed: Nov. 13, 1975

Related U.S. Application Data

[63] Continuation-in-part of Ser. No. 504,045, Sept. 9, 1974, abandoned.

[30] Foreign Application Priority Data

Sept. 10, 1973 Mexico ..... 146062

[51] Int. Cl.[2] ..... A63B 43/02

[52] U.S. Cl. ..... 273/55 B; 273/58 C; 273/DIG. 19; 272/143; 272/119; 272/77

[58] Field of Search ..... 273/55 R, 55 B, DIG. 19, 273/58 C, 95 A, 65; 272/143, 119, 77, 78

[56] References Cited

U.S. PATENT DOCUMENTS

| | | | |
|---|---|---|---|
| 2,186,016 | 1/1940 | Evans | 273/58 C X |
| 3,214,166 | 10/1965 | Gaudet | 273/95 A X |
| 3,509,660 | 5/1970 | Seymour | 273/95 A X |

FOREIGN PATENT DOCUMENTS

| | | | |
|---|---|---|---|
| 728,643 | 4/1932 | France | 273/95 A |

*Primary Examiner*—George J. Marlo
*Attorney, Agent, or Firm*—Jacobs & Jacobs

[57] ABSTRACT

A soccer training device comprises a soccer ball having a harpoon fitting piercing the ball and thus securing a swivel to the outside of the ball, a cord attached at one end to the swivel with the free end passing through a tube carried by a waist belt, which is worn around the waist of the player, and terminating in a handle, so that on manually pulling the cord through the tube by means of the handle, the distance between the ball and the player may be continually controlled as the player uses the device.

1 Claim, 3 Drawing Figures

FIG. 1
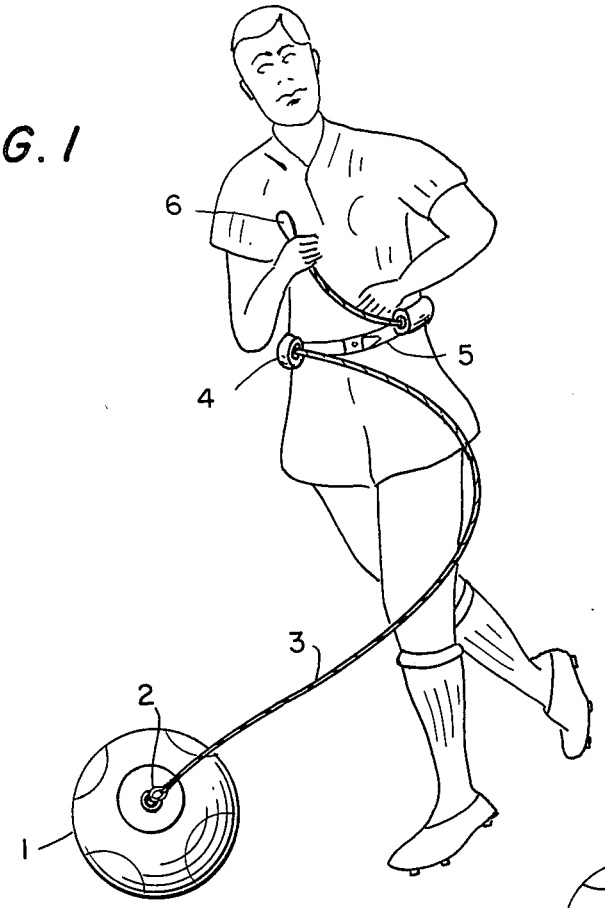
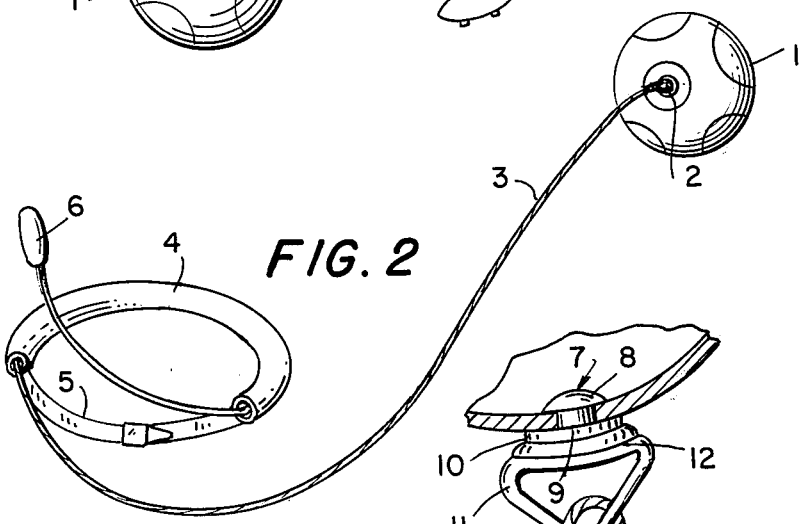
FIG. 2
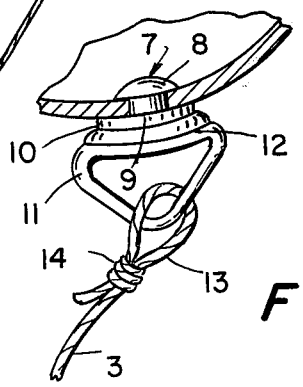
FIG. 3

LARGE FOOT BALLS OR SOCCER BALLS

This application is a continuation-in-part of my earlier application Ser. No. 504,045, filed Sept. 9, 1974, now abandoned.

This invention relates to the improvements in soccer balls in order to train soccer players.

The present invention provides a soccer training device, comprising:

a. a soccer ball;

b. harpoon means piercing said soccer ball and secured thereto, said harpoon means having a neck portion passing through the soccer ball, a protruberance at one end of the neck portion inside the soccer ball and a swivel at the other end of the neck portion outside the soccer ball;

c. an elongated belt adapted to be worn around the waist of a player and an elongated tube longitudinally extending along and attached to the belt, the openings of the tube facing toward the front of the player when the belt is worn by the player;

d. cord means passing through said tube and attached at one end to the swivel and at the other end to a handle, said cord means being operable to be manually moved through the tube by means of said handle, whereby the distance between the soccer ball and the player is under the continual control of the player during use.

This string (or cord) expands to a tube that is also fixed to a belt (fastened to the player's waist) by which the string gives the facility of adjusting the distance in which one or several players can practice soccer.

The handle, in all cases, is in front of the player and always is available to the player's hand so that he can pull or let go as often as desired to lengthen or shorten the distance of the ball (which is the final goal).

Up until now, there have been several ball games in which the ball can reach different distances according to the impetus which is given to it by the player who throws it. But these games are always performed with balls that have no attachment in order to control the distance. For if the ball does not have a cord, string, or any other elastic means, there is no distance control, and still less, there have no known soccer balls with controllable cord or strings.

As it is proposed in this invention, we offer this tube in which the string goes in and out as desired by means of a handle which is accessible to the player's hand. This controls the distance that the ball may reach so that one or more players can practice seriously or just for fun in order to improve their skills according to the coach's orders.

Other objects and advantages of the invention shall be obvious for any person skilled in the present art and other objects shall appear in the following description made of a preferred embodiment of the present invention, such description being given together with the attached drawings, in which:

FIG. 1 indicate a player in the attitude of kicking a foot ball controlled with a cord;

FIG. 2 shows a belt or band with a tube in which the string can go in and out under the player's control by pulling the handle, which is at the tube's front; and FIG. 3 indicates a small harpoon or anchor that holds firmly to the ball and at the same time the tip of the harpoon has a swivel attached to a string. In this manner the string has a swivel at one end, and the other end goes through the player's belt.

This invention, according to the illustrations in the drawings, has: 1, a ball 2, holding means, 3, a string or elastic band that goes through a 4, tube attached to a 5, belt thus leaving the 6, handle in the front so that the player's hand can freely pull or let go of the string and have control of the distance. A harpoon 7 has a neck portion 9 that penetrates through the ball 1 and an enlarged portion 8 that secures the harpoon 7 in place. A flange 10 serves as a guide for a swivel 11 having a safety latch 12. The end of cord 3 is formed into a loop 13 around the swivel 11 and knotted by knot 13. The swivel 11 allows the ball to twirl freely with the a result that the string 3, will not tangle during use.

What I claim is:

1. A soccer training device, comprising:

a. a soccer ball;

b. harpoon means piercing said soccer ball and secured thereto, said harpoon means having a neck portion passing through the soccer ball, a protruberance at one end of the neck portion inside the soccer ball and a swivel at the other end of the neck portion outside the soccer ball;

c. an elongated belt adapted to be worn around the waist of a player and an elongated tube longitudinally extending along and attached to the belt, the openings of the tube facing toward the front of the player when the belt is worn by the player;

d. cord means passing through said tube and attached at one end to the swivel and at the other end to a handle, said cord means being operable to be manually moved through the tube by means of said handle, whereby the distance between the soccer ball and the player is under the continual control of the player during use.

* * * * *